US008777561B2

(12) United States Patent
Beers et al.

(10) Patent No.: US 8,777,561 B2
(45) Date of Patent: Jul. 15, 2014

(54) COMPRESSOR SHROUD HAVING A RETENTION COVER CHANNEL FOR RECEIVING A RETENTION COVER

(75) Inventors: Craig M. Beers, Wethersfield, CT (US); Brent J. Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 882 days.

(21) Appl. No.: 12/940,313

(22) Filed: Nov. 5, 2010

(65) Prior Publication Data

US 2012/0114465 A1 May 10, 2012

(51) Int. Cl.
*F01D 17/16* (2006.01)

(52) U.S. Cl.
USPC ..... 415/151; 415/166

(58) Field of Classification Search
USPC ..... 415/151, 150, 148, 159, 166, 165, 163
See application file for complete search history.

(56) References Cited

U.S. PATENT DOCUMENTS

| | | | | |
|---|---|---|---|---|
| 4,194,359 | A | 3/1980 | Brookman et al. | |
| 4,529,355 | A | 7/1985 | Wilkinson | |
| 4,834,613 | A | 5/1989 | Hansen et al. | |
| 4,981,018 | A | 1/1991 | Jones et al. | |
| 5,186,601 | A | 2/1993 | Treece et al. | |
| 6,015,259 | A | 1/2000 | Sishtla et al. | |
| 6,039,534 | A | 3/2000 | Stoner et al. | |
| 6,179,557 | B1 | 1/2001 | Dodd et al. | |
| 6,790,000 | B2 | 9/2004 | Wolf | |
| 7,096,657 | B2 | 8/2006 | Mahoney et al. | |
| 7,189,059 | B2 | 3/2007 | Barton et al. | |
| 2010/0080694 | A1 * | 4/2010 | Chapman et al. | 415/160 |

* cited by examiner

*Primary Examiner* — Dwayne J White
(74) *Attorney, Agent, or Firm* — Carlson, Gaskey & Olds, P.C.

(57) ABSTRACT

An example compressor shroud assembly includes a shroud body extending along an axis and having a hollow bore. An enlarged flange is located at one axial end of the shroud body. The enlarged flange provides a rotating surface for a retention plate on a first side and a rotating surface for a drive ring on an opposing, second side. The enlarged flange establishes a channel that receives the retention plate. The channel has a ratio of the channel depth to the channel width that is between 0.0216 and 0.0251.

16 Claims, 4 Drawing Sheets

COMPRESSOR SHROUD HAVING A RETENTION COVER CHANNEL FOR RECEIVING A RETENTION COVER

BACKGROUND

This disclosure relates to a compressor shroud incorporated into a compressor for use in supplying cabin air in an aircraft.

Compressors are known and include a motor driven to rotate a shaft and in turn drive a compressor rotor. Some compressors include variable diffuser vanes. One end of the variable diffuser vanes is secured relative to a drive ring. Rotating the drive ring moves the variable diffuser vanes.

In one known compressor, the drive ring and the vanes are located on opposing sides of a compressor shroud flange. The compressor shroud flange establishes an annular channel on the vane side. Pins extend from the drive ring through apertures in the compressor shroud flange to drive the variable diffuser vanes. The apertures are established within the annular channel and at least partially covered by a retention plate that moves with the drive ring. The retention plate limits leakage through the apertures as the variable diffuser vanes are moved. The retention plate moves within the annular channel. In the past, the retention plate would sometimes bind when attempting to move the variable diffuser vanes.

SUMMARY

An example compressor shroud assembly includes a shroud body extending along an axis and having a hollow bore. An enlarged flange is located at one axial end of the shroud body. The enlarged flange provides a rotating surface for a retention plate on a first side and a rotating surface for a drive ring on an opposing, second side. The enlarged flange establishes a channel that receives the retention plate. The channel has a ratio of channel depth to channel width that is between 0.0216 and 0.0251.

An example variable diffuser assembly includes a retention plate, a drive plate, and a compressor shroud. The compressor shroud extends along an axis and has a hollow bore. The compressor shroud has an enlarged flange at one axial end of the shroud body that provides a rotating surface for the drive ring on a first side of the flange and establishes a channel on an opposing, second side of the flange. The channel is configured to receive the retention plate. An inner wall of the channel is spaced a first distance from the axis and a ratio of the first distance to the channel depth is between 493.4 and 569.5.

An example method of assembling a variable diffuser assembly includes providing a shroud body extending along an axis and having an enlarged flange at one axial end of the shroud body that provides a rotating surface for a retention plate on a first side and a rotating surface for a drive ring on an opposing, second side, the enlarged flange establishing an channel. The channel has a ratio of the channel depth to the channel width that is between 0.0216 and 0.0251. The method positions the retention plate within the channel. The method positions the drive ring against the second side and couples the drive ring with the retention plate and a plurality of diffuser vanes.

These and other features of the present invention can be best understood from the following specification and drawings, the following of which is a brief description.

DETAILED DESCRIPTION

Figure 1:
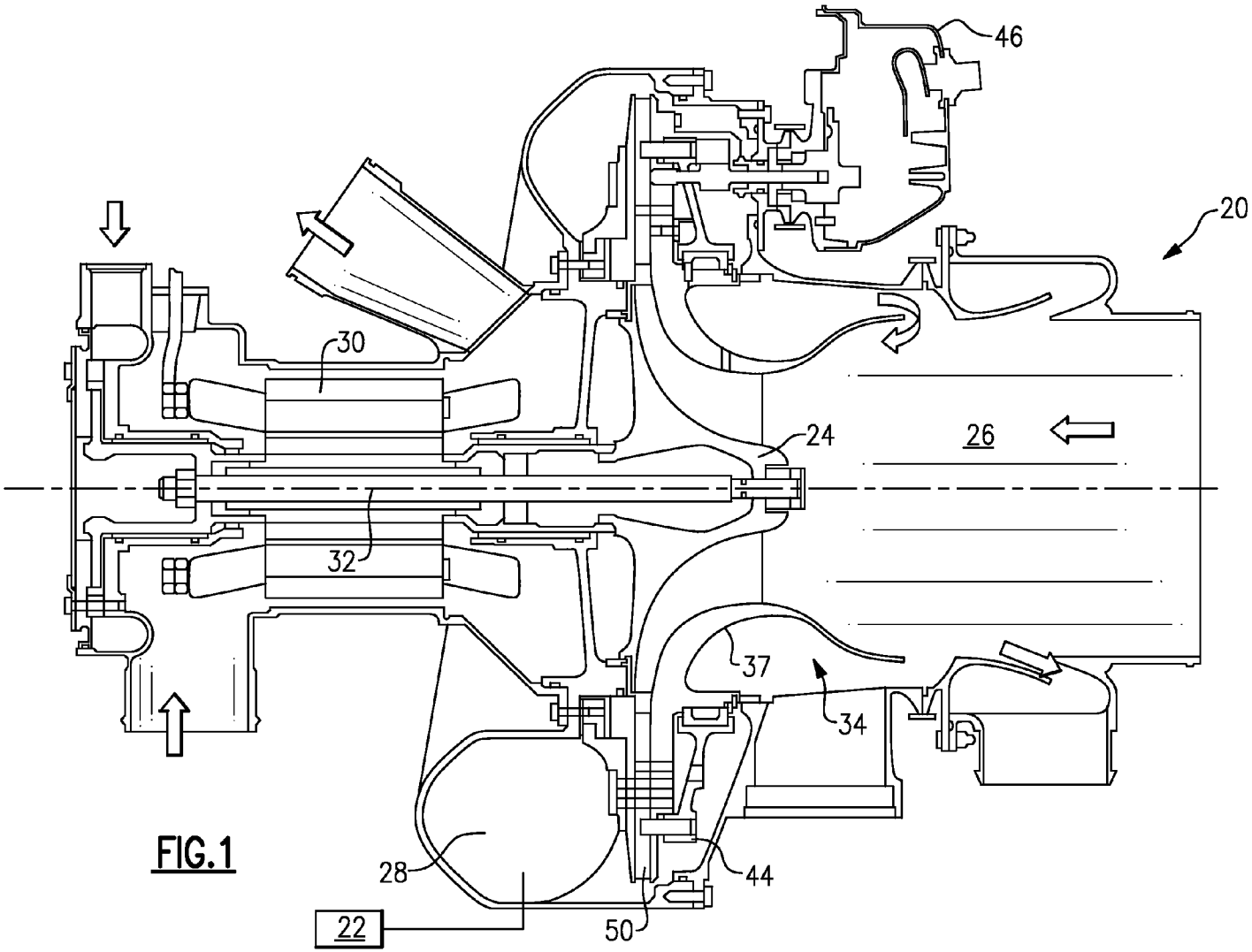
FIG. 1 is a cross-sectional view of a compressor incorporated into a cabin air supply.
Figure 2:
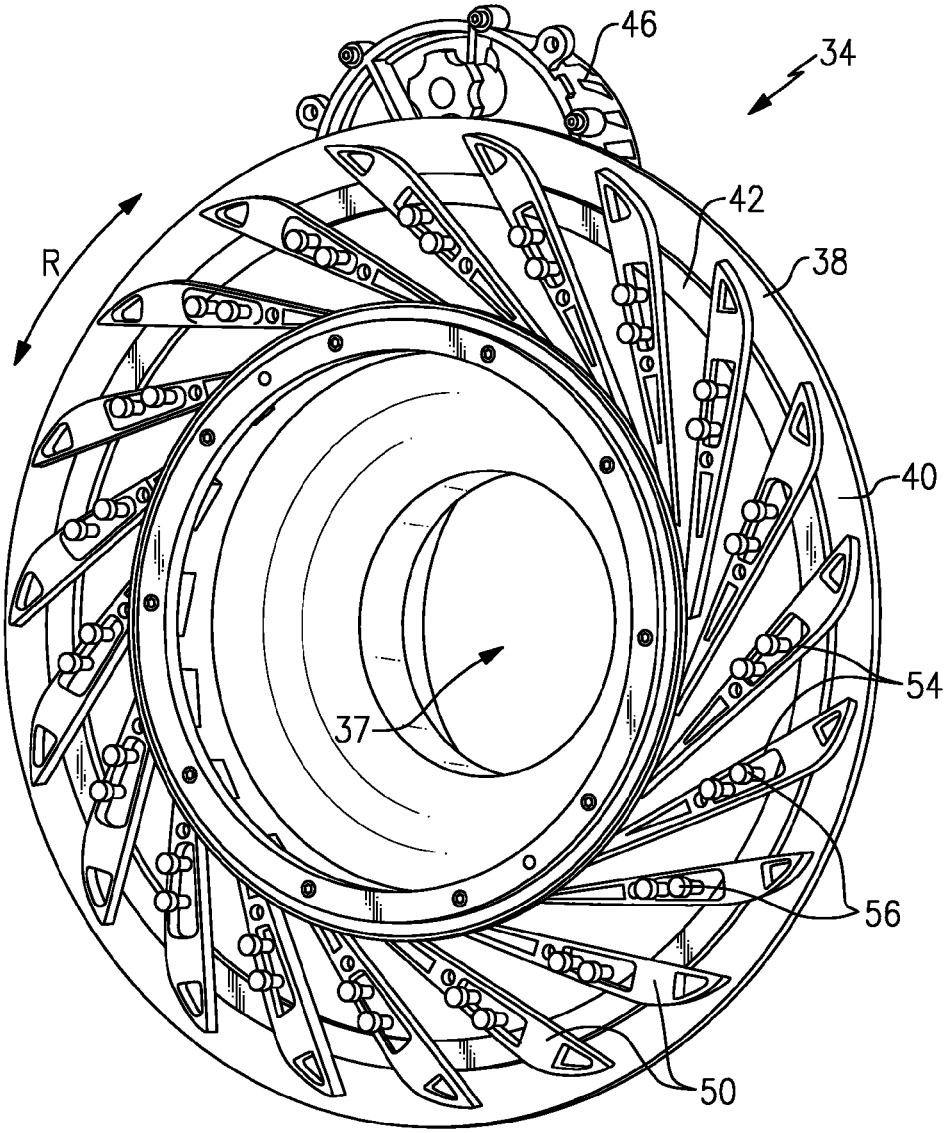
FIG. 2 is a first perspective view of a variable diffuser assembly that controls flow to the FIG. 1 compressor.
Figure 3:
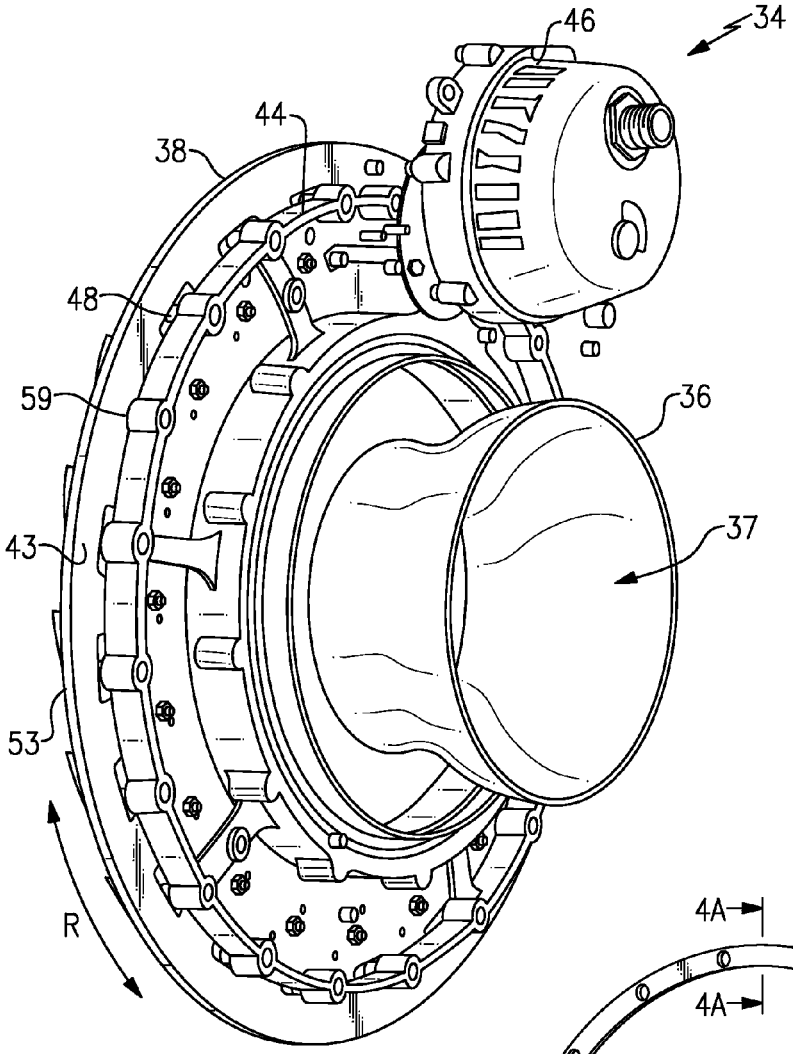
FIG. 3 is a second perspective view of a variable diffuser assembly that controls flow to the FIG. 1 compressor.

Referring to FIGS. 1-4, a compressor 20 is incorporated into a cabin air supply system 22 that passes air across the cabin of an aircraft. A rotor 24 receives air to be compressed from an inlet 26, and passes it to a compressor outlet 28. A motor 30 drives a tie rod, or driveshaft 32, to rotate the rotor 24.

An example variable diffuser assembly 34 has an axially extending bore 36 that communicates air to the inlet 26 of the compressor 20. The variable diffuser assembly 34 includes an axially extending shroud body 37. An enlarged flange 38 is positioned at one end of the shroud body 37. A first side 40 of the flange 38 provides a rotating surface for a retention plate 42. An opposing, second side 43 of the flange 38 provides a rotating surface for a drive ring 44.

An actuator 46 is coupled to the drive ring 44. Pins 48 extend from the drive ring 44 through the retention plate 42 to a plurality of diffuser vanes 50 distributed about the axis. Each of the pins 48 extends through an aperture 52 defined within the retention plate 42. The pins 48 also extend through slots 53 established in the flange 38. The drive ring 44 is coupled to the diffuser vanes 50 through the pins 48.

The diffuser vanes 50 also each establish an aperture 54 that receives a pivot pin 56 extending from the first side 40 of the flange 38. The diffuser vanes 50 are pivotable about the pivot pins 56 to control flow of air though the bore 37 as is known.

In this example, the actuator 46 is configured to rotate the drive ring 44 back and forth about the axis in the direction R. This rotation of the drive ring 44 causes the pins 48 extending from the drive ring 44 to rotate, which causes the diffuser vanes 50 to pivot about the pivot pins 56.

The retention plate 42 blocks air from flowing through the slots 76 as the pins 48 move within the slots 53. The example retention plate 42 is made of a corrosion resistant steel material. The example variable diffuser assembly 34 consists of a shroud body 37 made of an aluminum material. Other examples may include other types of materials for the retention plate 42 and the variable diffuser assembly 34.

Figure 4A:
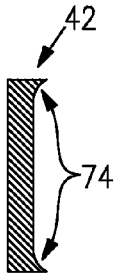
FIG. 4A shows a section view at line 4A-4A in FIG. 4.
Figure 4:
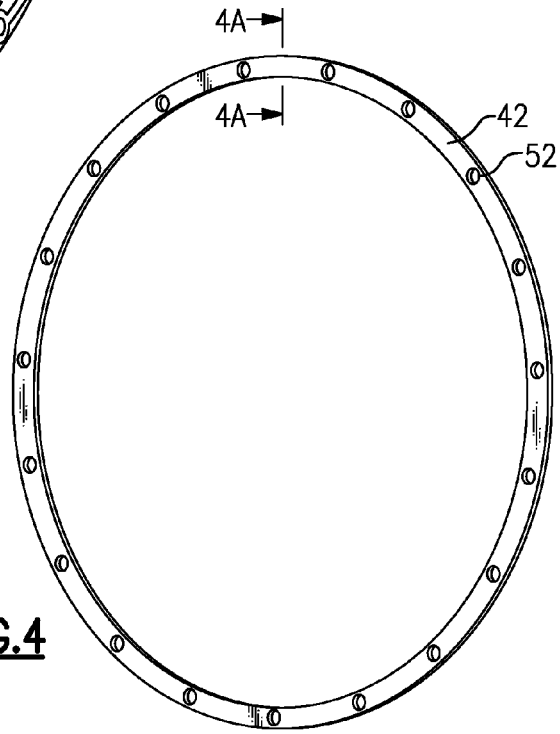
FIG. 4 shows a perspective view of the retention plate in the FIG. 2 variable diffuser assembly.
Figure 5:
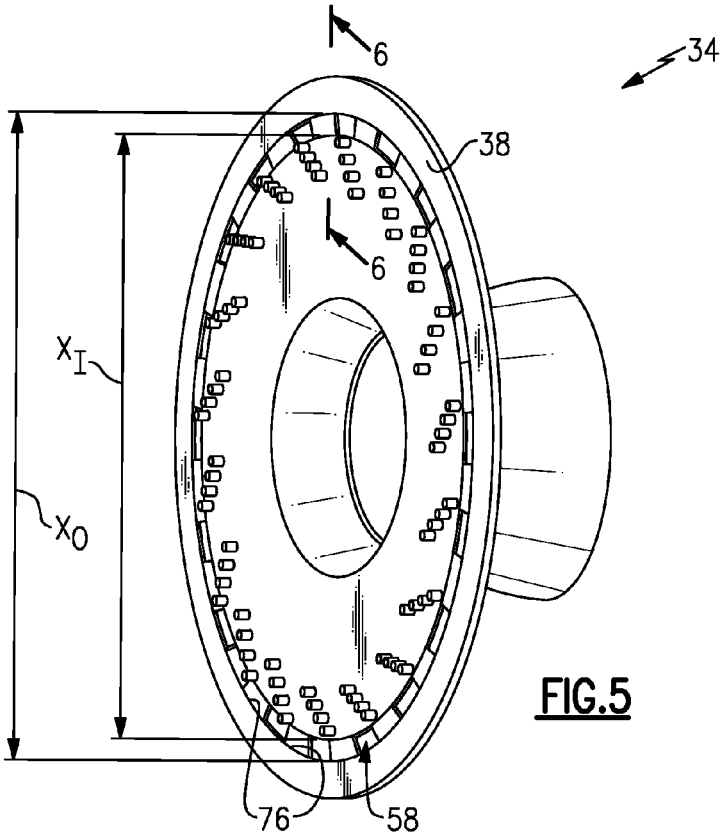
FIG. 5 shows a perspective view of the shroud in the FIG. 2 variable diffuser assembly.
Figure 6:
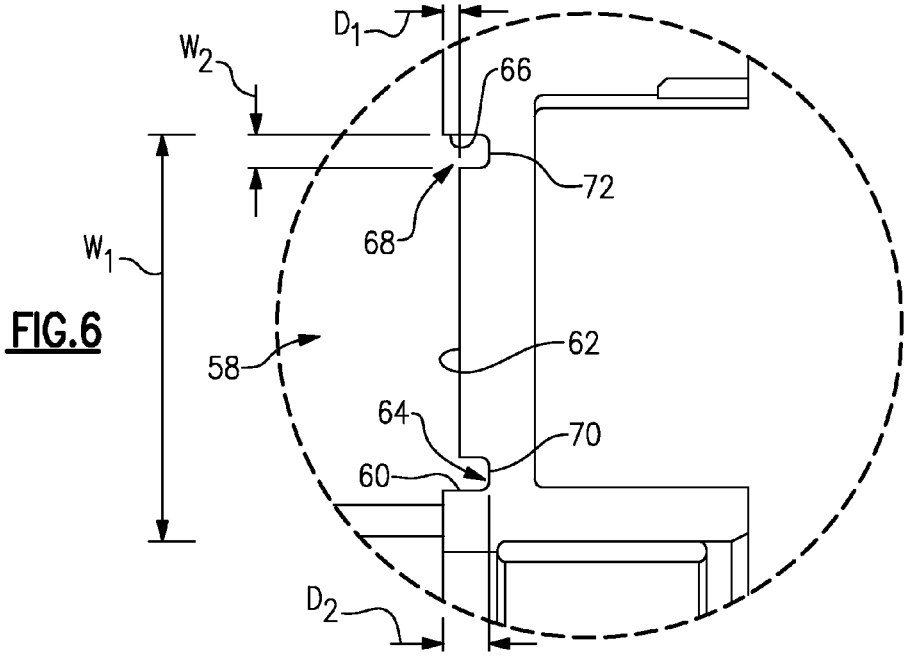
FIG. 6 shows a cross-sectional view at line 6-6 in FIG. 5.

Referring now to FIG. 6 with continued reference to FIGS. 2-5, the retention plate 42 rotates back and forth within a channel 58 established in the flange 38. The channel 58 is defined by a radially inner wall 60 that meets a floor 62 of the channel 58 at an interface 64. The channel 58 is further defined by a radially outer wall 66 that meets the floor 62 of the channel 58 at an interface 68.

A first relief notch 70 is located at the first interface 64. A second relief notch 72 is located at the interface 68. In some examples, the retention plate 42 includes burrs 74, or other imperfections. The burrs 74 are due to the manufacturing process used to create the retention plate 42, such as stamping the retention plate 42 from a sheet of material. The first relief notch 70 and the second relief notch 72 accommodate the burrs 74 and thus facilitate movement of the retention plate 42 within the channel 58.

As shown in FIG. 6 with continuing reference to FIGS. 4 and 5, the channel 58 has a depth $D_1$ that is between 0.026 and 0.030 inches (between 0.660 and 0.762 millimeters), and in a specific example is 0.028 inches (0.711 millimeters). The channel 58 has a Width $W_1$ that is between 1.301 and 1.289 inches (between 33.05 and 32.74 millimeters), and in the specific example is 1.295 inches (32.89 millimeters). Thus, in the specific example, the ratio of the depth $D_1$ to the width $W_1$ is 0.022. The ratio of $D_1$ to the width $W_1$ is between 0.0216 and 0.0251 in this example.

In this example, the relief notch 70 and the relief notch 72 have a depth $D_2$ that is 0.078 inches (1.98 millimeters) and a width $W_2$ that is 0.060 inches (1.52 millimeters). Thus, the relief notch has a depth that is 0.050 inches (1.27 millimeters) greater than the channel depth.

The outer diameter $X_O$ of the channel is between 16.097 and 16.103 inches (408.86 and 409.02 millimeters), and in the specific example is 16.100 inches (408.94 millimeters). The inner diameter $X_I$ of the channel is between 14.802 and 14.808 inches (375.97 and 376.12 millimeters), and in the specific example is 14.805 inches (376.05 millimeters).

The outer diameter $X_O$ of the channel 58 corresponds generally to the outer diameter of the retention plate 42, and the inner diameter $X_I$ of the channel 58 corresponds generally to the inner diameter of the retention plate 42. In this example, the ratio of an inner diameter $X_I$ of the channel 58 to the depth of the channel 58 is between 493.4 and 569.5. In this example, the ratio of an outer diameter $X_O$ of the channel 58 to the depth of the channel 58 is between 536.5 and 619.3. Further, a ratio of an inner diameter $X_I$ of the channel 58 to the width of the channel 58 is between 12.31 and 12.39, and a ratio of an outer diameter $X_O$ of the channel 58 to the width of the channel 58 is between 13.39 and 13.47.

Referring again to FIG. 1, in a method of assembling the variable diffuser 34, the shroud body 37 is provided that extends along an axis and has the flange 38. The retention plate 42 is positioned within the channel 58 on one side of the flange 38. The drive ring 44 is positioned against the opposing, second side, of the flange 38.

The pins 48 of the drive ring 44 are positioned within the apertures 52 of the retention plate 42. The pins 48 are coupled to the diffuser vanes 50. The actuator 46 can then be coupled to the drive ring44 to actuate the diffuser vanes 50.

Although an embodiment of this invention has been disclosed, a worker of ordinary skill in this art would recognize that certain modifications would come within the scope of this invention. For that reason, the following claims should be studied to determine the true scope and content of this invention.

We claim:

1. A compressor shroud assembly, comprising;

a shroud body extending along an axis and having a hollow bore;

an enlarged flange at one axial end of the shroud body that provides a rotating surface for a retention plate on a first side and a rotating surface for a drive ring on an opposing, second side, the enlarged flange establishing a channel that receives the retention plate, the channel having a ratio of the channel depth to the channel width that is between 0.0216 and 0.0251; and a first relief notch at a first interface between a radially inner wall and a floor of the channel, a second relief notch at a second interface between a radially outer wall and the floor of the channel or both.

2. The compressor shroud of claim 1, wherein the first relief notch has a notch depth that is at least 0.050 inches (1.27 millimeters) greater than the channel depth.

3. The compressor shroud of claim 1, wherein a ratio of an inner diameter of the channel to the depth of the channel is between 493.4 and 569.5.

4. The compressor shroud of claim 1, wherein a ratio of an outer diameter of the channel to the depth of the channel is between 536.5 and 619.3.

5. The compressor shroud of claim 1, wherein a ratio of an inner diameter of the channel to the width of the channel is between 12.31 and 12.39.

6. The compressor shroud of claim 1, wherein a ratio of an outer diameter of the channel to the width of the channel is between 13.39 and 13.47.

7. The compressor shroud of claim 1, wherein the enlarged flange comprises a plurality of apertures that are radially aligned with the channel.

8. The compressor shroud of claim 1, wherein the channel is configured to receive the retention plate such that the retention plate is rotatable relative to the enlarged flange.

9. The compressor shroud of claim 1, wherein the channel faces outwardly away from the remaining portions of the shroud body.

10. A variable diffuser assembly, comprising;

a retention plate;

a drive plate; and a compressor shroud extending along an axis and having a hollow bore, the compressor shroud having an enlarged flange at one axial end of the shroud body that provides a rotating surface for the drive ring on a first side of the flange and establishes a channel on an opposing, second side of the flange, the channel configured to receive the retention plate, wherein an inner wall of the channel is spaced a first distance from the axis and a ratio of the first distance to the channel depth is between 493.4 and 569.5.

11. The variable diffuser assembly of claim 10, wherein an outer wall of the channel is spaced a second distance from the axis, wherein the ratio of the first distance to the second distance is between 536.5 and 619.3.

12. The variable diffuser assembly of claim 10, including a first relief notch at a first interface between the inner wall and a floor of the channel, a second relief notch at a second interface between the outer wall and the floor of the channel, or both.

13. The variable diffuser assembly of claim 10, wherein the retention plate is configured to move a plurality of diffuser vanes.

14. The variable diffuser assembly of claim 10, including extension pins that rotatably couple the drive ring to the retention plate, the extension pins extending through an aperture established in the flange.

15. The variable diffuser assembly of claim 10, wherein the compressor shroud forms a portion of a cabin air compressor for use in an aircraft.

16. A method of assembling a variable diffuser assembly comprising the steps of:

(a) providing a shroud body extending along an axis and having an enlarged flange at one axial end of the shroud body that provides a rotating surface for a retention plate on a first side and a rotating surface for a drive ring on an opposing, second side, the enlarged flange establishing an channel, wherein the channel has a ratio of the channel depth to the channel width that is between 0.0216 and 0.0251;

(b) positioning the retention plate within the channel; and (c) positioning the drive ring against the second side and coupling the drive ring with the retention plate and a plurality of diffuser vanes.

* * * * *